US006467420B1

(12) United States Patent
Komatsu

(10) Patent No.: US 6,467,420 B1
(45) Date of Patent: Oct. 22, 2002

(54) CLOTH HAVING EMBROIDERY PATTERN AND METHOD FOR FORMING EMBROIDERY PATTERN

(76) Inventor: Teruaki Komatsu, 890-12, Nakamocho, Gojo-shi, Nara (JP)

( * ) Notice: Subject to any disclaimer, the term of this patent is extended or adjusted under 35 U.S.C. 154(b) by 0 days.

(21) Appl. No.: 09/979,550

(22) PCT Filed: May 22, 2000

(86) PCT No.: PCT/JP00/03283

§ 371 (c)(1),
(2), (4) Date: Nov. 21, 2001

(87) PCT Pub. No.: WO00/71801

PCT Pub. Date: Nov. 30, 2000

(30) Foreign Application Priority Data

May 24, 1999 (JP) ..... 11-143442
Dec. 10, 1999 (JP) ..... 11-351319

(51) Int. Cl.[7] ..... D05C 15/00; D05C 17/00
(52) U.S. Cl. ..... 112/475.22
(58) Field of Search ..... 112/475.18, 475.22, 112/475.23, 439, 293; 156/93, 59, 322

(56) References Cited

U.S. PATENT DOCUMENTS 1,409,214 A * 3/1922 Einstein ..... 112/410
1,976,349 A * 10/1934 Kleinert ..... 112/475.18
2,876,525 A * 3/1959 Janney et al. ..... 112/475.22
5,423,928 A * 6/1995 Hambright ..... 112/475.09
5,609,119 A * 3/1997 Yeh ..... 112/103
5,832,854 A * 11/1998 Lin et al. ..... 112/439

FOREIGN PATENT DOCUMENTS

| | | |
|---|---|---|
| JP | S43-8593 | 4/1968 |
| JP | S47-15670 | 6/1972 |
| JP | S47-19589 | 6/1972 |
| JP | S52-18970 | 2/1977 |
| JP | S53-45429 | 12/1978 |
| JP | H5-195411 | 8/1993 |
| JP | H11-315466 | 11/1999 |

* cited by examiner

*Primary Examiner*—Ismael Izaguirre
(74) *Attorney, Agent, or Firm*—Koda & Androlia

(57) ABSTRACT

A method for forming an embroidery pattern which comprises embroidering a cloth (1) for embroider by the use of an ordinary embroidery yam as a needle thread (2) and, as a bobbin thread (5), a yam obtained by twisting together an ordinary yarn used usually and a yam formed with a material capable of thermal fusion splicing or a yam obtained by covering an ordinary yam with a material capable of thermal fusion splicing, then heating them to fuse the material capable of thermal fusion splicing in the bobbin thread (5) and splice the ordinary yam of the bobbin thread and the needle thread (2) appearing on the back of the above cloth (1) to the back of the above cloth (1), and cutting each needle thread (2) appearing on the front surface of the cloth (1) at an intermediate portion thereof, thereby fluffing the needle thread (2) out; and a cloth having an embroidery pattern formed by the method or a method similar to that. The method can be used for obtaining an embroidery pattern which is stereoscopic and profound and forming an embroidery pattern of an intricate shape with ease.

6 Claims, 5 Drawing Sheets

(A)

(B)

(A)

(B)

CLOTH HAVING EMBROIDERY PATTERN AND METHOD FOR FORMING EMBROIDERY PATTERN

TECHNICAL FIELD

The present invention relates to a cloth having an embroidery pattern and a method for forming the embroidery pattern.

BACKGROUND ART

FIG. 6 shows how conventional sewing machine embroidery is performed. A procedure, wherein a needle thread 2 is passed through from the front surface to the back surface of a cloth 1, hooked to a bobbin thread 3 as shown in FIG. 6(B) and taken out to the front surface, is repeated. As a result, embroidery of letters, symbols, figures, etc. (hereafter generally referred to as an embroidery pattern) is formed by the needle thread 2 on the front surface as shown in FIG. 6(A). However, the embroidery pattern formed in this way is flat and not stereoscopic.

In addition, when the cloth 1 having the conventional embroidery pattern is used for clothing making direct contact with the skin, the bobbin thread 3 and the fold-back portion of the needle thread 2 entangled with the bobbin thread 3 on the back surface of the cloth 1 make direct contact with the skin and irritates the skin, whereby an uncomfortable feeling is given and may cause inflammation on the skin. To solve this problem, the cloth 1 having the embroidery pattern is cut off around the contour of the embroidery pattern, and this cloth is bonded onto a cloth 4 for clothing or the like as shown in FIG. 7. However, this method takes time and effort to cut off the cloth 1 around the contour of the embroidery pattern. Furthermore, the cutting becomes difficult unless the embroidery pattern has a simple and plain shape. Still further, the portion of the embroidery pattern becomes thick and stiff.

In consideration of these points, an object of the present invention is to provide a stereoscopic and profound embroidery pattern, and a second object of the present invention is to form an embroidery pattern without cutting off the cloth having the embroidery pattern even when the embroidery pattern has an intricate shape.

DISCLOSURE OF INVENTION

In order to attain the above-mentioned objects, a cloth having an embroidery pattern in accordance with the present invention is characterized in that the intermediate portion of each needle thread of the embroidery pattern, appearing on the front surface of a cloth, is cut and removed to fluff the needle threads.

An embroidery pattern having needle threads fluffed as described above is formed as described below for example. That is to say, an embroidery pattern is obtained by embroidering layers of an embroidery cloth and one or plural cloths or sheets overlaid on the embroidery cloth, by the use of an ordinary embroidery yarn as a needle thread and, as a bobbin thread, a yarn obtained by twisting together an ordinary yarn used usually (hereafter simply referred to as an "ordinary yarn") as a bobbin thread for embroidery and a yarn formed of a material capable of thermal fusion splicing or a yarn obtained by covering an ordinary yarn with a material capable of thermal fusion splicing, by carrying out heating to fuse the material capable of thermal fusion splicing in the bobbin thread and to splice the ordinary yarn of the bobbin thread and the needle thread appearing on the back surface of the cloth to the back surface of the cloth, and by cutting and removing the intermediate portion of each needle thread appearing on the front surface, and by removing the overlaid cloths or sheets to form an embroidery pattern having fluffed needle threads on a desired cloth.

A bobbin thread formed of a material capable of thermal fusion splicing may be used instead of the above-mentioned bobbin thread. In this case, the whole of the bobbin thread is fused, and the needle thread appearing on the back surface of the cloth is spliced to the back surface of the cloth.

Furthermore, an embroidery pattern having fluffy needle threads is formed on a desired cloth by embroidering an embroidery sheet, at least the back surface of which is treated so that no yarn adheres thereto and on which one or plural cloths or sheets are overlaid, by the use of an ordinary embroidery yarn as a needle thread and, as a bobbin thread, a yarn obtained by twisting together an ordinary yarn and a yarn formed of a material capable of thermal fusion splicing or a yarn obtained by covering an ordinary yarn with a material capable of thermal fusion splicing, by overlaying the embroidery sheet on a cloth on which an embroidery pattern is formed, with the front surface of the embroidery sheet placed upward, by carrying out heating to fuse the material capable of thermal fusion splicing in the bobbin thread and to splice the ordinary yarn of the bobbin thread and the needle thread appearing on the back surface of the sheet to the cloth, by cutting and removing the intermediate portion of each needle thread appearing on the front surface, and by separating the embroidery sheet and the cloths or sheets overlaid thereon from the cloth.

BEST MODE FOR CARRYING OUT THE INVENTION

Next, embodiments of the present invention will be described.

In a first embodiment, a general and ordinary yarn for embroidery is used as a needle thread 2. Furthermore, a yarn obtained by twisting together an ordinary yarn and a yarn formed of a material capable of thermal fusion splicing, which becomes an adhesive when fused by heat, so as to be configured to include the material capable of thermal fusion splicing, or a yarn obtained by passing an ordinary yarn through the liquid of a fused material capable of thermal fusion splicing so that its surface is covered with the material capable of thermal fusion splicing so as to be configured to include the material capable of thermal fusion splicing, is used as a bobbin thread 5. The material capable of thermal fusion splicing may be colorless or colored.

Figure 1:
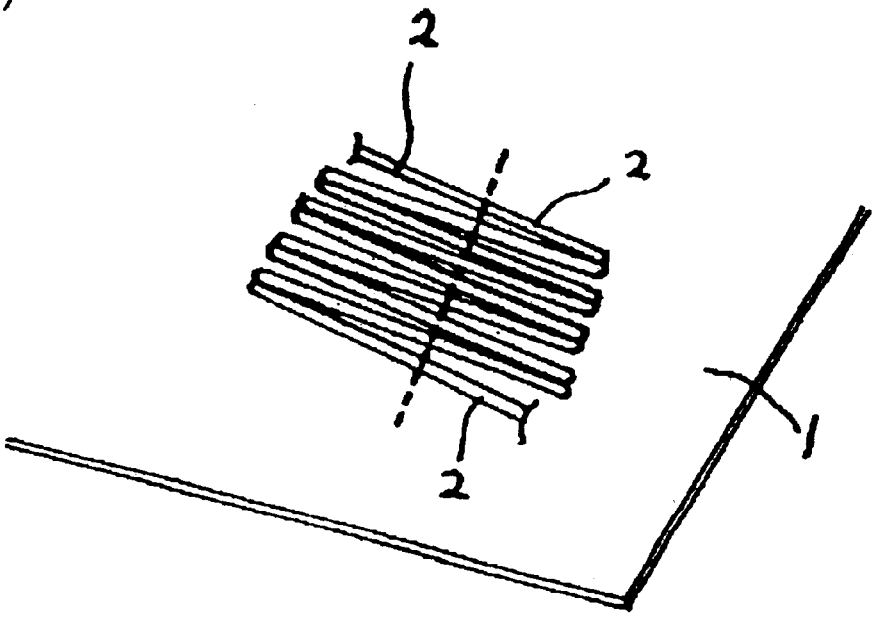
FIG. 1(A) is an explanatory view showing the condition of a needle thread on the front surface of a cloth having an embroidery pattern.
FIG. 1(B) is an explanatory view showing the condition of a bobbin thread on the back surface of the cloth in accordance with the present invention.
Figure 1:
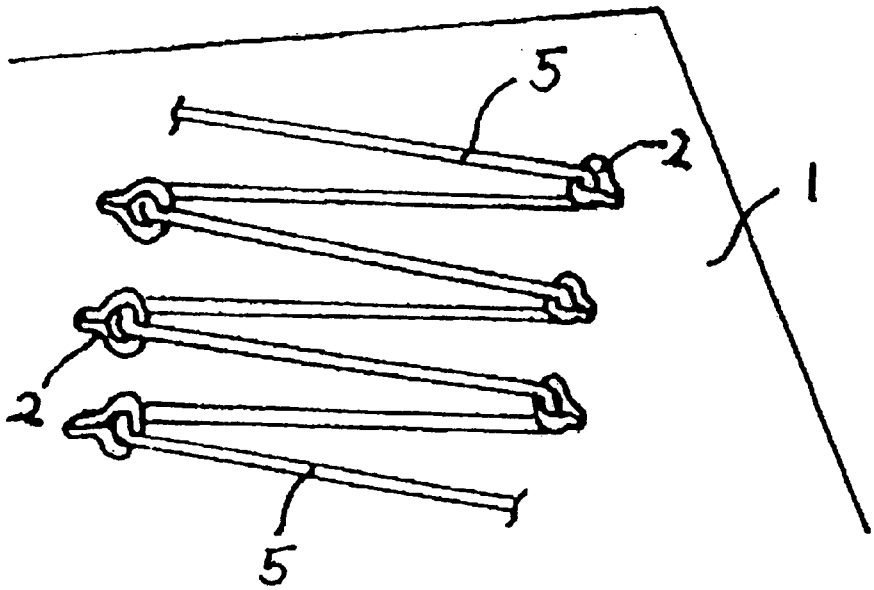

An embroidery pattern is formed on a cloth 1 by the use of the needle thread 2 and the bobbin thread 5 as shown in FIG. 1, and the formed embroidery pattern is heat-pressed with a heater, such as an iron, from above or from the back surface of the cloth 1 to fuse the material capable of thermal fusion splicing in the bobbin thread 5. Hence, the material capable of thermal fusion splicing becomes an adhesive, whereby the ordinary yarn in the bobbin thread 5 and the portion of the needle thread 2 appearing on the back surface of the cloth 1 are spliced to the back surface of the cloth 1. The means for heat-pressing is not limited to the iron, but any other appropriate means can be used.

Next, the intermediate portion of each needle thread 2 indicated by the broken line of FIG. 1(A) is cut and removed. Hence, the needle threads 2 are fluffed, and it is possible to obtain a stereoscopic and profound embroidery pattern. Furthermore, even an embroidery pattern having an intricate shape can be formed easily without cutting the cloth 1 or overlaying the cloth 1 on another cloth.

Figure 2:
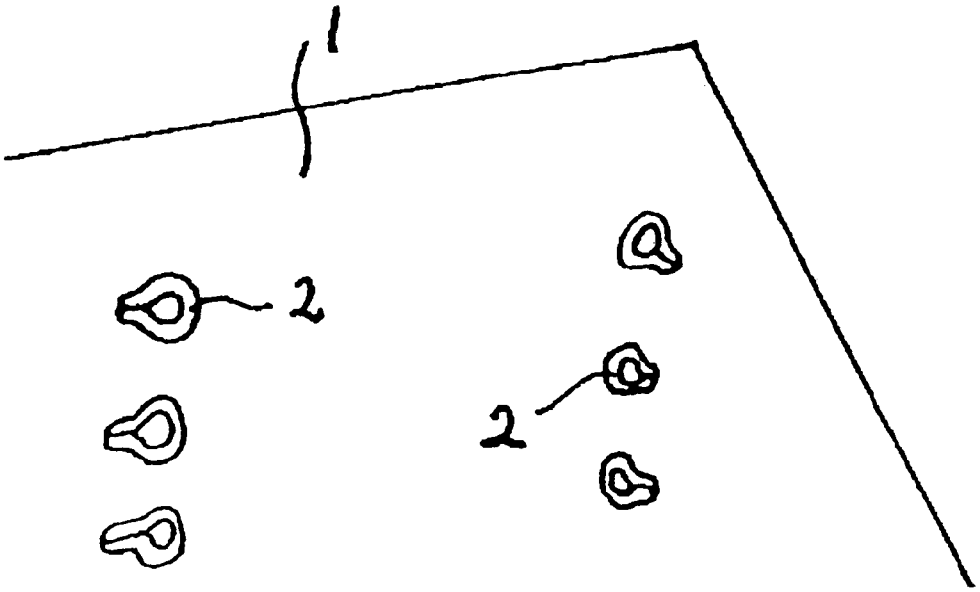
FIG. 2 is an explanatory view showing a condition wherein a bobbin thread formed of a material capable of thermal fusion splicing is fused and disappears on the back surface of the cloth having the embroidery pattern.

In a second embodiment, an ordinary yarn for embroidery is used as the needle thread 2, just as in the case of the above-mentioned first embodiment. However, a yarn formed of only a material capable of thermal fusion splicing, which becomes an adhesive when fused by heat, is used as the bobbin thread 5. An embroidery pattern is formed on the cloth 1 by the use of the needle thread 2 and the bobbin thread 5, just as in the case of the first embodiment, and the formed embroidery pattern is heat-pressed with a heater, such as an iron, from above or from the back surface of the cloth 1 to fuse the bobbin thread 5. Hence, the material capable of thermal fusion splicing, that is, the bobbin thread 5, becomes an adhesive, whereby the portion of the needle thread 2 appearing on the back surface of the cloth 1 is spliced to the back surface of the cloth 1 as shown in FIG. 2. Thus, in this case, the bobbin thread 5 does not remain in a clear form, unlike the case of the first embodiment wherein the bobbin thread 5 remains on the back surface of the cloth 1 as shown in FIG. 1(B).

Next, the intermediate portion of each needle thread 2 appearing on the front surface is cut and removed, just as in the case of the first embodiment. Hence, the needle threads 2 are fluffed, and it is possible to obtain a stereoscopic and profound embroidery pattern.

The basic requirements of the first and second embodiments are described above. In reality, embroidery is carried out in a condition wherein one or plural cloths or sheets are overlaid additionally on the cloth 1. The additionally overlaid cloths or sheets are removed after the intermediate portion of each needle thread 2 is cut and removed. By overlaying the cloths or sheets in this way, the intermediate portion of each needle thread 2 can be cut and removed easily. Furthermore, by appropriately selecting the whole thickness by adjusting the number of the cloths or sheets, the lengths of the needle threads 2 remaining after the cutting can be adjusted to a desired equal dimension. Still further, the overlaid cloths or sheets prevent the fused material capable of thermal fusion splicing in the bobbin thread 5 from flowing to the upper portions of the needle threads 2, whereby the needle threads 2 are not spliced to the front surface of the cloth 1, thereby not becoming in a falling condition. Hence, all the needle threads 2 remaining after the cutting stand upright and have an equal length, thereby being effective in obtaining a stereoscopic embroidery pattern.

In a third embodiment, an ordinary yarn for embroidery is used as the needle thread 2, and a yarn obtained by twisting together an ordinary yarn and a yarn formed of a material capable of thermal fusion splicing or a yarn obtained by covered its surface with a material capable of thermal fusion splicing, so as to be configured to include the material capable of thermal fusion splicing is used as the bobbin thread 5, just as in the case of the first embodiment. An embroidery sheet 6 is embroidered first.

On this embroidery sheet 6, an embroidery pattern is formed temporarily, and the embroidery sheet 6 is configured so that no yarn adheres to at least the back surface thereof. More specifically, the back surface of the sheet made of paper, cloth, plastic or the like for example is covered with a mold release agent, such as a silicon resin or fluorocarbon resin, so that the fused material capable of thermal fusion splicing does not adhere thereto. Or the sheet itself is formed of a plastic sheet or the like formed of a resin used for a mold release agent.

Figure 3:
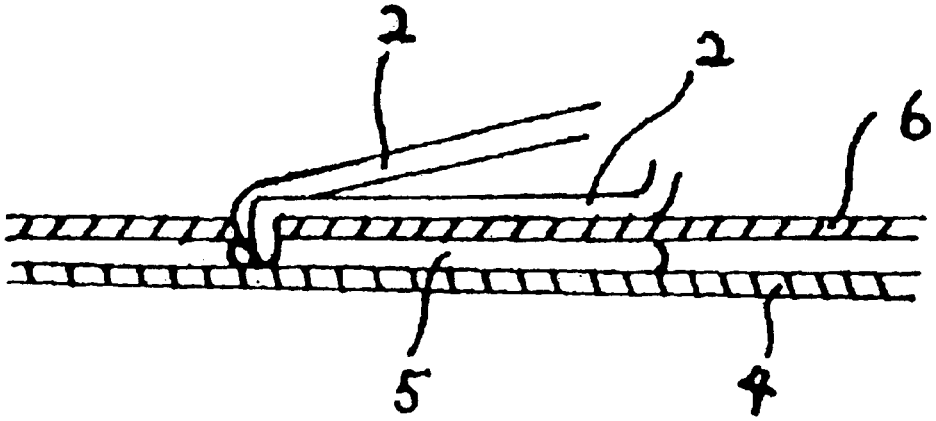
FIG. 3 is an explanatory view showing a condition wherein an embroidery sheet having an embroidery pattern is overlaid on a cloth.

Next, as shown in FIG. 3, the embroidery sheet 6, with its front surface placed upward, is overlaid on a cloth 4 on which an embroidery pattern is to be formed, and the embroidery pattern is heat-pressed with a heater, such as an iron, from above or from the back surface of the cloth 4 to fuse the material capable of thermal fusion splicing in the bobbin thread 5, just as in the case of the above-mentioned embodiment, whereby the ordinary yarn of the bobbin thread 5 and the needle thread 2 appearing on the back surface of the sheet 6 are spliced to the cloth 4. The cloth 4 is formed of a cloth that is not scorched or degraded when subjected to the heating.

Figure 4:
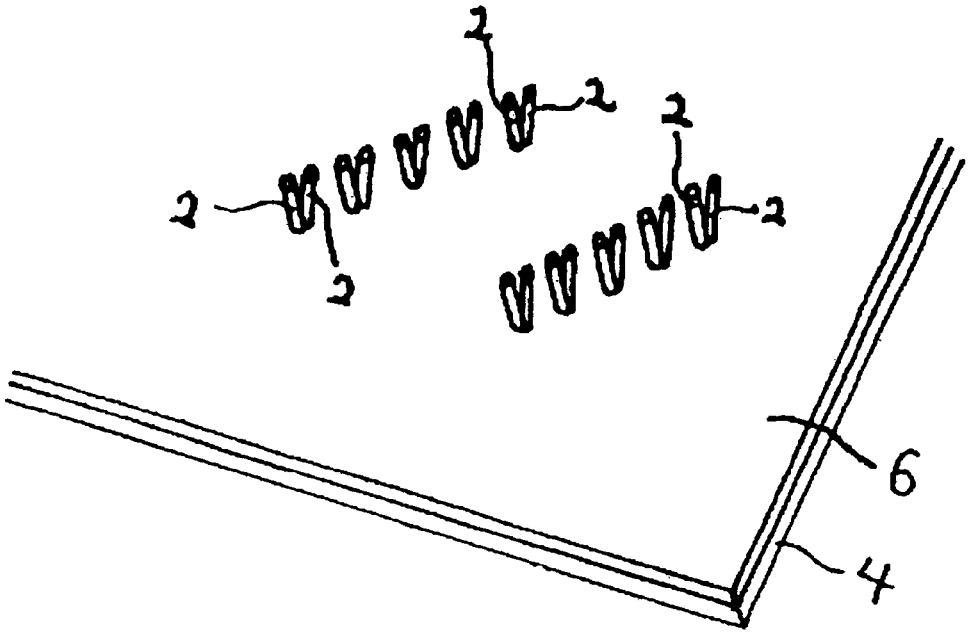
FIG. 4 is an explanatory view showing a condition wherein the intermediate portion of each needle thread on the front surface of the embroidery sheet having the embroidery pattern is cut and removed.
Figure 7:
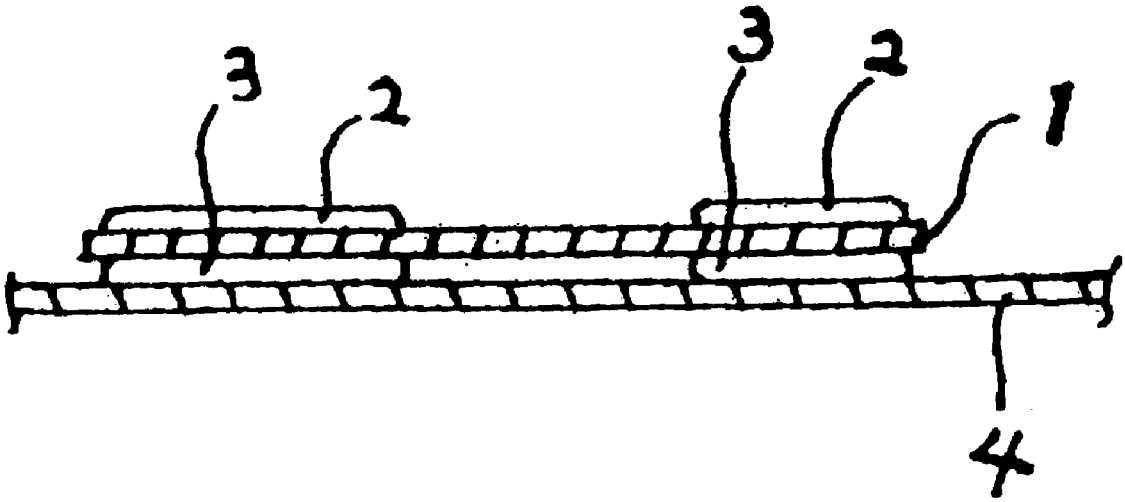
FIG. 7 is an explanatory view showing a condition wherein a sheet having an embroidery pattern is overlaid on a cloth in accordance with the conventional embroidery.

Next, when the intermediate portion of each needle thread 2 appearing on the front surface is cut and removed (see FIG. 4), and when the sheet 6 is lifted while the cloth 4 is held down, the cut needle threads 2 come out of the perforations in the sheet 6, and the sheet 6 is separated from the cloth 4, whereby the embroidery pattern transferred from the sheet 6 is formed on the cloth 4. No embroidery threads appear on the back surface of the cloth 4, just as in the case of FIG. 7. The above-mentioned cutting and removing of the needle threads 2 may be carried out before the embroidery sheet 6 is overlaid on the cloth 4.

Figure 5:
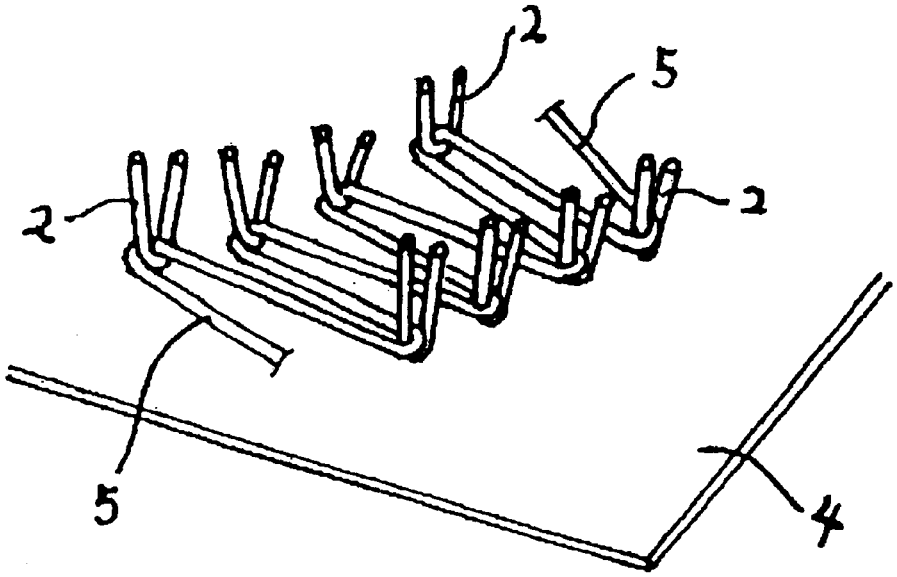
FIG. 5 is an explanatory view showing a condition wherein the embroidery sheet is removed from the cloth.
Figure 6:
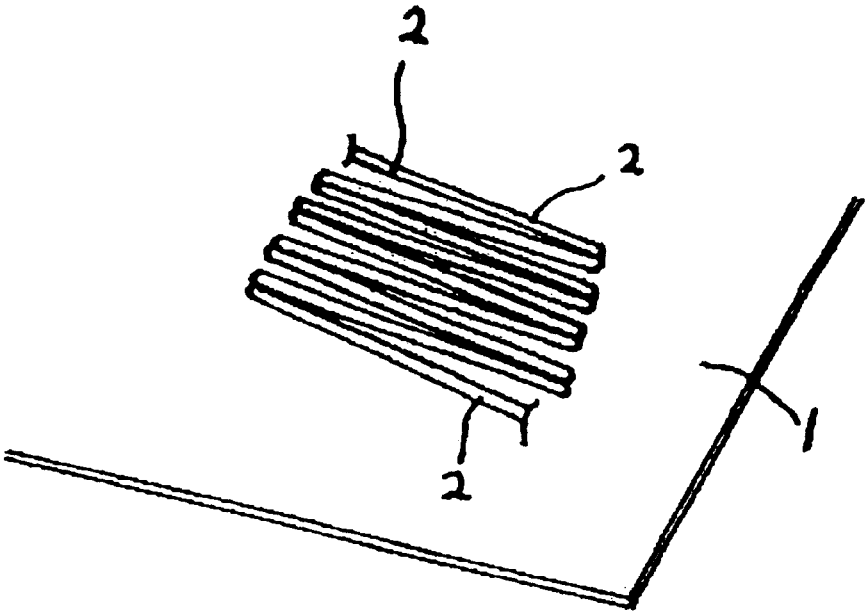
FIG. 6(A) is an explanatory view showing the condition of a needle thread on the front surface of a cloth.
FIG. 6(B) is an explanatory view showing the condition of a bobbin thread on the back surface of the cloth in accordance with conventional embroidery.
Figure 6:
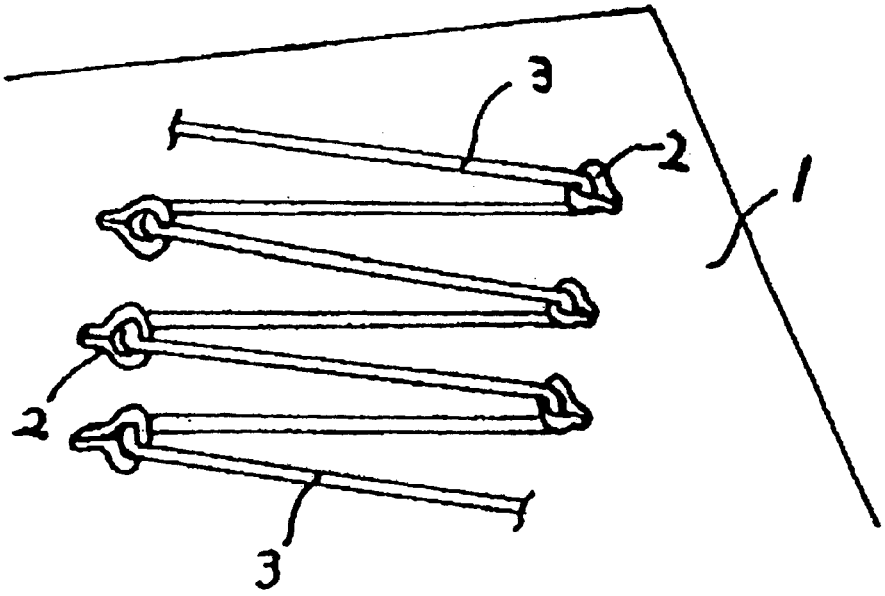

In the embroidery pattern transferred to the cloth 4 as described in the above procedure, the bobbin thread 5 is spliced to the cloth 4 while holding the needle threads 2 as shown in FIG. 5; hence, the needle threads 2 remaining after the cutting do not come out. Furthermore, the needle threads 2 become fluffy, just as in the case of the above-mentioned embodiment.

The basic requirements of the third embodiment are described above. In reality, embroidery is carried out in a condition wherein one or plural cloths or sheets are overlaid additionally on the embroidery sheet 6, just as in the case of the above-mentioned first and second embodiments. The additionally overlaid cloths or sheets are removed together with the embroidery sheet 6 after the intermediate portion of each needle thread 2 is cut and removed. By overlaying the cloths or sheets in this way, the intermediate portion of each needle thread 2 can be cut and removed easily, the lengths of the remaining needle threads 2 can be adjusted, and all the remaining needle threads 2 stand upright, just as in the case of the first and second embodiments.

In addition, in this embodiment, after the embroidery sheet 6 is removed, the ordinary yarn of the bobbin thread 5 as well as the needle threads 2 appear on the front surface of the cloth 4, thereby forming an embroidery pattern. Hence, an embroidery pattern in two colors can be obtained by appropriately selecting the colors of the needle thread 2 and the ordinary yarn of the bobbin thread 5. Or a colorful embroidery pattern can be formed by the use of a plurality of colors including white at each portion of the embroidery pattern.

As described above, in accordance with the present invention, the needle threads are fluffed, whereby it is possible to obtain a stereoscopic and profound embroidery pattern. Furthermore, the bobbin thread and the needle threads appearing on the back surface of the cloth are covered with the material capable of thermal fusion splicing and unexposed directly, or in the case of the third embodiment, no threads appear on the back surface of the cloth. Therefore, the threads do not irritate the skin, thereby giving no uncomfortable feeling and causing no inflammation on the skin. Hence, it is not necessary to cut off the cloth around the contour of the embroidery pattern and to bond the cloth to another cloth, whereby it is possible to easily form an embroidery pattern having an intricate shape. Still further, a colorful embroidery pattern can be formed easily, and the portion of the embroidery pattern does not become thick or stiff.

INDUSTRIAL APPLICABILITY

As described above, the present invention can easily provide stereoscopic and profound embroidery patterns, embroidery patterns having intricate shapes, colorful embroidery patterns, etc. and thus useful as a method for obtaining cloths having embroidery patterns.

What is claimed is:

1. A method for forming an embroidery pattern, comprising embroidering an embroidery cloth (1), on which one or plural cloths or sheets are overlaid, by the use of an ordinary embroidery yarn as a needle thread (2) and, as a bobbin thread (5), a yarn obtained by twisting together an ordinary yarn used usually as a bobbin thread for embroidery and a yarn formed of a material capable of thermal fusion splicing or a yarn obtained by covering an ordinary yarn with a material capable of thermal fusion splicing, carrying out heating to fuse said material capable of thermal fusion splicing in said bobbin thread (5) and to splice said ordinary yarn of said bobbin thread (5) and said needle thread (2) appearing on the back surface of said cloth (1) to the back surface of said cloth (1), and cutting and removing the intermediate portion of each needle thread (2) appearing on the front surface, and removing said overlaid cloths or sheets to form an embroidery pattern having fluffed needle threads (2) on said cloth (1).

2. A cloth having an embroidery pattern obtained by embroidering, an embroidery cloth (1), on which one or plural cloths or sheets are overlaid, by the use of an ordinary embroidery yarn as a needle thread (2) and, as a bobbin thread (5), a yarn obtained by twisting together an ordinary yarn used usually as a bobbin thread for embroidery and a yarn formed of a material capable of thermal fusion splicing or a yarn obtained by covering an ordinary yarn with a material capable of thermal fusion splicing, by carrying out heating to fuse said material capable of thermal fusion splicing in said bobbin thread (5) and to splice said ordinary yarn of said bobbin thread (5) and said needle thread (2) appearing on the back surface of said cloth (1) to the back surface of said cloth (1), and by cutting and removing the intermediate portion of each needle thread (2) appearing on the front surface, and by removing said overlaid cloths or sheets to form an embroidery pattern having fluffed needle threads (2) on said cloth (1).

3. A method for forming an embroidery pattern, comprising embroidering an embroidery cloth (1), on which one or plural cloths or sheets are overlaid, by the use of an ordinary embroidery yarn as a needle thread (2) and, as a bobbin thread (5), a yarn formed of a material capable of thermal fusion splicing, carrying out heating to fuse said bobbin thread (5) and to splice said needle thread (2) appearing on the back surface of said cloth(1) to the back surface of said cloth (1), and cutting and removing the intermediate portion of each needle thread (2) appearing on the front surface, and removing said overlaid cloths or sheets to form an embroidery pattern having fluffed needle threads (2) on said cloth (1).

4. A cloth having an embroidery pattern obtained by embroidering an embroidery cloth (1), on which one or plural cloths or sheets are overlaid, by the use of an ordinary embroidery yarn as a needle thread (2) and, as a bobbin thread (5), a yarn formed of a material capable of thermal fusion splicing, by carrying out heating to fuse said bobbin thread (5) and to splice said needle thread (2) appearing on the back surface of said cloth (1) to the back surface of said cloth (1), and by cutting and removing the intermediate portion of each needle thread (2) appearing on the front surface, and by removing said overlaid cloths or sheets to form an embroidery pattern having fluffed needle threads (2) on said cloth (1).

5. A method for forming an embroidery pattern, comprising embroidering an embroidery sheet (6), at least the back surface of which is treated so that no yarn adheres thereto and on which one or plural cloths or sheets are overlaid, by the use of an ordinary embroidery yarn as a needle thread (2) and, as a bobbin thread (5), a yarn obtained by twisting together an ordinary yarn used usually as a bobbin thread for embroidery and a yarn formed of a material capable of thermal fusion splicing or a yarn obtained by covering an ordinary yarn with a material capable of thermal fusion splicing, overlaying said embroidery sheet (6) on a cloth (4) on which an embroidery pattern is formed, with the front surface of said sheet (6) placed upward, carrying out heating to fuse said material capable of thermal fusion splicing in said bobbin thread (5) and to splice said ordinary yarn of said bobbin thread (5) and said needle thread (2) appearing on the back surface of said embroidery sheet (6) to said cloth (4), cutting and removing the intermediate portion of each needle thread (2) appearing on the front surface, and separating said embroidery sheet (6) and said cloths or sheets overlaid thereon from said cloth (4) to form an embroidery pattern having fluffed needle threads (2) on said cloth (4).

6. A cloth having an embroidery pattern obtained by embroidering an embroidery sheet (6), at least the back surface of which is treated so that no yarn adheres thereto and on which one or plural cloths or sheets are overlaid, by the use of an ordinary embroidery yarn as a needle thread (2) and, as a bobbin thread (5), a yarn obtained by twisting together an ordinary yarn used usually as a bobbin thread for embroidery and a yarn formed of a material capable of thermal fusion splicing or a yarn obtained by covering an ordinary yarn with a material capable of thermal fusion splicing, by overlaying said embroidery sheet (6) on a cloth (4) on which an embroidery pattern is formed, with the front surface of said sheet (6) placed upward, by carrying out heating to fuse said material capable of thermal fusion splicing in said bobbin thread (5) and to splice said ordinary yarn of said bobbin thread (5) and said needle thread (2) appearing on the back surface of said embroidery sheet (6) to said cloth (4), by cutting and removing the intermediate portion of each needle thread (2) appearing on the front surface, and by separating said embroidery sheet (6) and said cloths or sheets overlaid thereon from said cloth (4) to form an embroidery pattern having fluffed needle threads (2) on said cloth (4).

* * * * *